US006833034B1

(12) United States Patent
Thomas, Jr.

(10) Patent No.: US 6,833,034 B1
(45) Date of Patent: Dec. 21, 2004

(54) SCUFF MARK REMOVAL TOOL

(76) Inventor: Will Thomas, Jr., P.O. Box 1033, Harvey, IL (US) 60426

( * ) Notice: Subject to any disclaimer, the term of this patent is extended or adjusted under 35 U.S.C. 154(b) by 0 days.

(21) Appl. No.: 10/617,415

(22) Filed: Jul. 10, 2003

(51) Int. Cl.[7] ..... A47L 13/28

(52) U.S. Cl. ..... 134/6; 15/104.001; 15/209.1; 15/210.1; D32/51

(58) Field of Search ..... 15/104.001, 145, 15/176.2, 160, 209.1, 210.1, 228, 229.11, 229.13; 134/6; D4/127, 137; D32/35, 40, 50–52

(56) References Cited

U.S. PATENT DOCUMENTS

| | | | | | |
|---|---|---|---|---|---|
| 239,126 | A | * | 3/1881 | Wagner | 15/143.1 |
| 2,258,547 | A | * | 10/1941 | Dodds | 15/210.1 |
| 6,668,414 | B1 | * | 12/2003 | Benjamin, Jr. | 15/104.001 |
| 2004/0040105 | A1 | * | 3/2004 | Hillenbrand | 15/104.001 |

* cited by examiner

*Primary Examiner*—Mark Spisich
(74) *Attorney, Agent, or Firm*—Goldstein Law Offices, P.C.

(57) ABSTRACT

A scuff mark removal tool used to remove tar, dirt, and rubber scuff marks from an uncarpeted floor surface. The tool has a handle portion and a felt-covered ball attached to the handle portion. The felt-covering on the ball effectively removes the scuff marks when rubbed against the marks without scratching the floor surface.

3 Claims, 2 Drawing Sheets

SCUFF MARK REMOVAL TOOL

BACKGROUND OF THE INVENTION

The invention relates to a scuff mark removal tool. In particular, the invention is a tool that aids a person in removing scuff marks from uncarpeted floor surfaces while remaining in an upright standing position.

People often try to keep a clean environment in their homes and workplaces. This is accomplished by routine cleaning of the area by the home owner or by a custodian of an office, store, or school. One important chore involved in the routine cleaning is removing scuff marks from uncarpeted areas of the floor. Scuff marks result when shoe soles, chairs, furniture, or similar items rub across the uncarpeted floor surface and leave residue, thereby causing black marks on the floor surface. Scuff marks are particularly prevalent on linoleum and wood floors. These black marks are often composed of dirt, tar, or rubber and are difficult to remove with ordinary cleaning products. Further, because of the stubborn nature of the marks, cleaning the floor with a mop normally does not rid the surface of the marks.

In order to rid the floor surface of these unsightly scuff marks, it is often necessary for a person to scrub the area on his or her hands and knees. Direct and concentrated contact with the marks is sometimes the only means of removing said marks. This can cause a great strain on a person's body, particularly his or her knees and shoulders. Moreover, kneeling down on the floor typically causes the person to become dirty.

Thus, there exists a need for a tool that enables a person to thoroughly clean scuff marks from an uncarpeted floor surface without having to kneel down to the floor. Such a tool would be held by the user while the user is standing. The distal end of the tool is rubbed over the marked area, thereby removing any tar, dirt, or rubber marks therefrom.

While the units available may be suitable for the particular purpose employed, or for general use, they would not be as suitable for the purposes of the present invention as disclosed hereafter.

SUMMARY OF THE INVENTION

In view of the foregoing disadvantages inherent in the prior art, the present invention provides an improved scuff mark removal tool. As such, the general purpose of the present invention, which will be described subsequently in greater detail, is to provide a new and improved scuff mark removal tool which has all the advantages of the prior art and none of the disadvantages.

To attain this, the present invention essentially comprises a scuff mark removal tool used to remove tar, dirt, and rubber scuff marks from an uncarpeted floor surface. The tool has a handle portion and a felt-covered ball attached to the handle portion. The felt-covering on the ball effectively removes the scuff marks when rubbed against the marks without scratching the floor surface. The ball allows the tool to be effectively used while the handle is held at almost any angle with respect to the floor.

It is an object of the invention to produce a scuff mark removal tool that allows a user to effectively removes marks from an uncarpeted floor surface while remaining in a standing position. Accordingly, the user holds the proximal end of the tool and positions the distal end of the tool over the marked area of the floor. Downward pressure is then applied to the tool as the user maneuvers the tool distal end over the area until the mark is removed.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

REFERENCE NUMERALS

Figure 1:
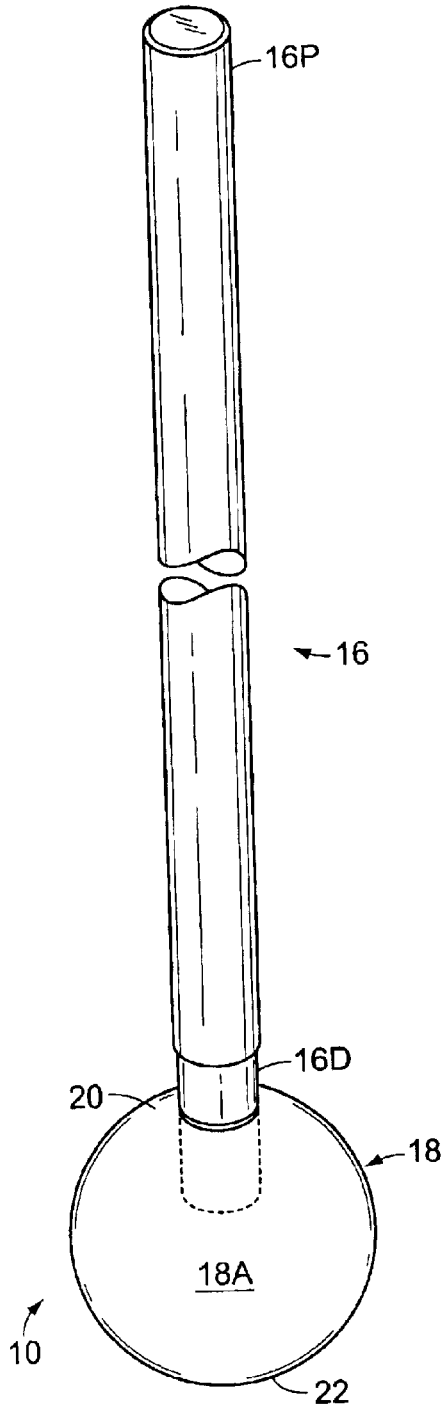
FIG. 1 is a diagrammatic perspective view of the scuff mark removal tool, illustrating the handle portion mated with the ball.

10 scuff mark removal tool
12 scuff mark
14 floor surface
16 handle portion
16D handle portion threaded distal end
16P handle portion proximal end
18 ball
18A ball outer covering
20 ball top end
22 ball bottom end
24 ball threaded aperture
26 user

DETAILED DESCRIPTION OF THE PREFERRED EMBODIMENTS

Figure 2:
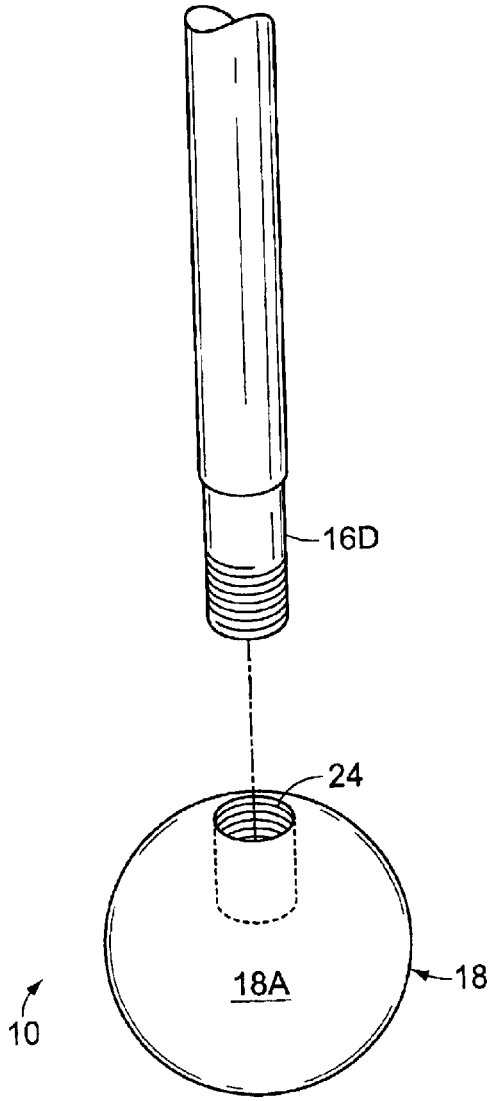
FIG. 2 is an exploded view of the tool, illustrating attachment of the handle portion with the ball.
Figure 3:
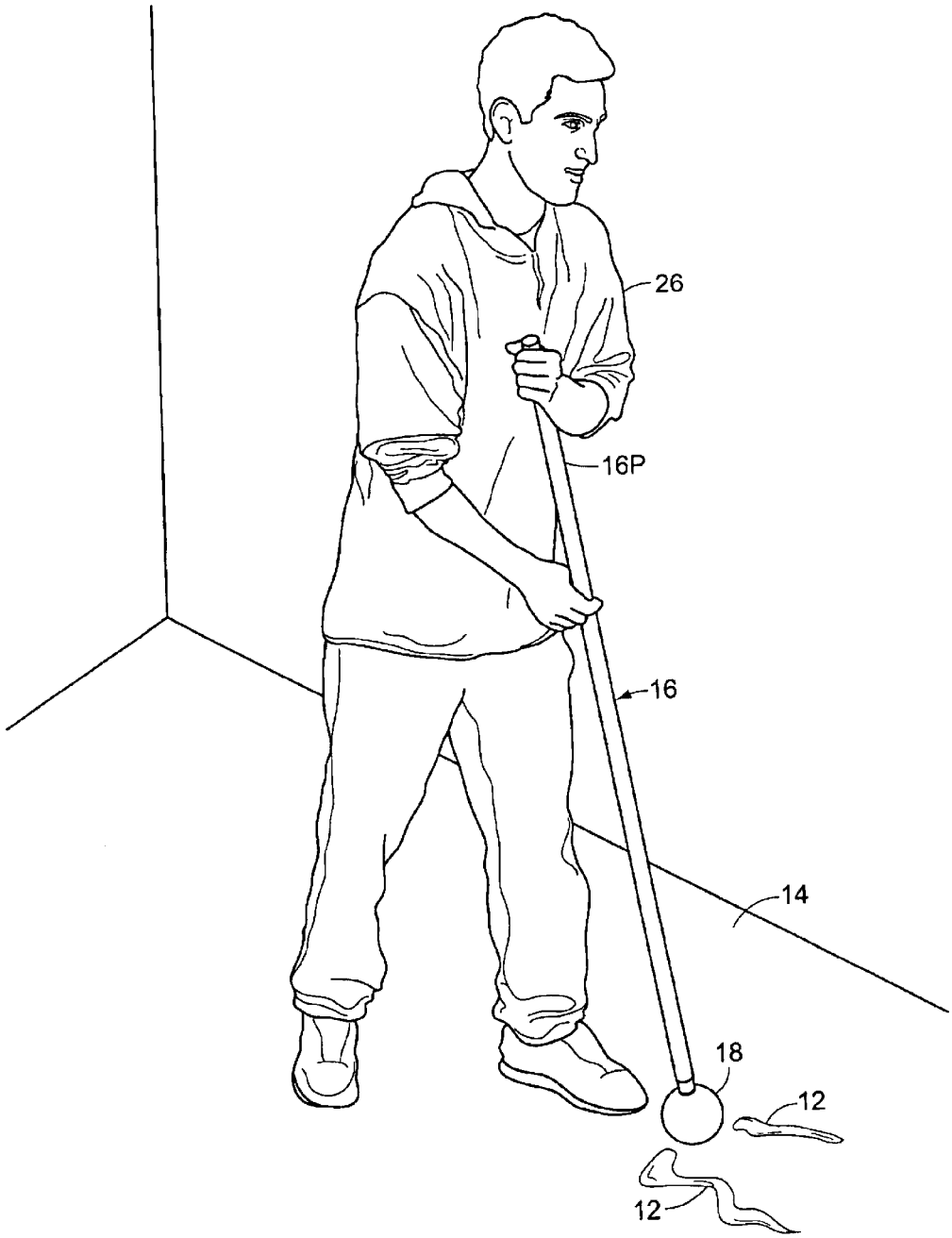
FIG. 3 is a diagrammatic perspective view of the scuff mark removal tool in use, removing scuff marks from a floor surface.

FIGS. 1–3 illustrate a scuff mark removal tool 10 that is used to remove tar, dirt, and rubber scuff marks 12 from an uncarpeted floor surface 14. The tool 10 essentially comprises an elongated handle portion 16 and a felt-covered ball 18 attached to the handle portion 16. The ball 18 is substantially spherical and is preferably made from a resilient material, such as rubber.

The removal tool handle portion 16 comprises a threaded distal end 16D and a proximal end 16P. Referring momentarily to FIG. 3, the proximal end 16P is held by a user 26, while the distal end 16D is directed downward towards the marked floor surface 14. The distal end 16D of the handle 16 is threaded in order to be selectively mateable with the ball 18, as will be described in greater detail hereinafter.

The handle portion 16 is preferably constructed from a lightweight durable material that is resistant to bending or snapping when downward pressure is applied thereto. Suitable materials include, but are not limited to, wood, metal, or plastic. While the handle portion 16 may be constructed with different lengths for users' of various heights, said portion 16 is preferably approximately thirty-three (33") inches in length with a diameter of approximately one and one-half (1½") inches.

The ball 18 has an outer covering 18A, said outer covering 18A being fabricated from a tightly woven synthetic or wool felt material. This material is effective in removing scuff marks 12 from the floor surface 14 without scratching said floor surface 14. Further, the rubber interior of the ball 18 provided the necessary support for the ball 18 when pressure is applied thereto, yet is resilient for preventing fatigue to the user 26.

The ball 18 further comprises a top end 20 and a bottom end 22, said top end 20 having a threaded aperture 24 extending downward into the ball 18 from the ball outer covering 18A. The threaded aperture 24 is sized to accommodate the threaded distal end 16D of the handle portion 16. As illustrated in FIG. 2, the threaded distal end 16D of the handle 16 is selectively mated with the threaded aperture 24 in order to secure the ball 18 thereto.

While the tool 10 is intended for use in removing scuff marks 12 from uncarpeted floor surfaces 14, it is important to note that the use of the tool 10 is not limited to removing scuff marks from any particular surface. Because of the length of the handle portion 16, the tool 10 may be employed in reaching scuff marks on hard to reach areas, such as cabinets, doors, and ceilings. Further, the tool 10 may be utilized outdoors in removing marks from window shutters, exterior doors, and automobile tire walls, hubcaps, and rims.

In use, the handle threaded distal end 16D is threaded into the ball threaded aperture 24. The handle portion 16 is tightened within the ball 18 in order to prevent unintentional removal of the ball 18 therefrom during use. Once the handle portion 16 is secured within the ball 18, the user 26 grips the handle proximal end 16P and the ball bottom end 22 is brought into contact with the marked floor surface 14. The user 26 then applies downward pressure on the handle 16 while maneuvering the ball outer surface 18A against the scuff mark 12 until said mark 12 is removed from the floor surface 14. Once soiled, the ball 18 may be replaced with a new, unused ball 18 as necessary.

In conclusion, herein is presented a scuff mark removal tool. The invention is illustrated by example in the drawing figures, and throughout the written description. It should be understood that numerous variations are possible, while adhering to the inventive concept. Such variations are contemplated as being a part of the present invention.

What is claimed is:

1. A scuff mark removal tool for removing scuff marks from an uncarpeted floor surface, the tool comprising:

a ball, the ball being substantially spherical and comprising an outer covering, a top end having an internally threaded aperture that extends into the ball from the ball outer covering, and a bottom end, whereby the ball outer covering is fabricated from a tightly woven felt material; and an elongated handle portion, the handle portion comprising a proximal end and a distal end, the proximal end being held by a user during use, and the distal end being having external threading for being selectively secured to the ball within the aperture.

2. A scuff mark removal tool as recited in claim 1, wherein the handle portion is constructed from a lightweight, durable material.

3. A method of removing scuff marks from an uncarpeted floor surface having scuff marks using a scuff mark removal tool, the tool comprising an elongated handle portion and a substantially spherical ball, the handle portion having a proximal end and an externally threaded distal end, and the ball having a soft outer covering of tightly woven felt material, a top end, and a bottom end, the top end having an internally threaded aperture extending into the ball from the ball outer surface, comprising the steps of;

threading the distal end of the handle into the ball threaded aperture;

tightening the handle portion within the ball aperture;

gripping the handle proximal end by the user;

bringing the ball bottom end into contact with the floor surface; and removing the scuff mark by applying downward pressure on the handle portion by the user and maneuvering the ball outer surface across the scuff mark on the floor surface.

* * * * *